US005645712A

United States Patent [19]

Roth

[11] Patent Number: 5,645,712

[45] Date of Patent: Jul. 8, 1997

[54] METHOD FOR INCREASING YIELD OF LIQUID PRODUCTS IN A DELAYED COKING PROCESS

[75] Inventor: Jim R. Roth, Ponca City, Okla.

[73] Assignee: Conoco Inc., Ponca City, Okla.

[21] Appl. No.: 618,876

[22] Filed: Mar. 20, 1996

[51] Int. Cl.[6] ..... C10G 9/14

[52] U.S. Cl. ..... 208/131; 208/50

[58] Field of Search ..... 208/131, 50

[56] References Cited

U.S. PATENT DOCUMENTS 4,455,219 6/1984 Janssen et al. .
4,492,625 1/1985 Allan ..... 208/131
4,501,645 2/1985 Allan ..... 208/131
4,518,487 5/1985 Graf et al. ..... 208/131
4,661,241 4/1987 Dabkowski et al. .
5,028,311 7/1991 Shigheg et al. ..... 208/131

*Primary Examiner*—Helane Myers
*Attorney, Agent, or Firm*—C. R. Schupbach

[57] ABSTRACT

In a delayed coking process the temperature of the liquid in the coke drum is increased by the addition of a heated non-coking hydrocarbon diluent. The heated non-coking diluent can be added to either a delayed coker furnace effluent prior to entering the coke drum, directly into the coke drum, or both. The resulting increase in coke drum temperature results in increased liquid yields and a decrease in coke yields.

14 Claims, 1 Drawing Sheet

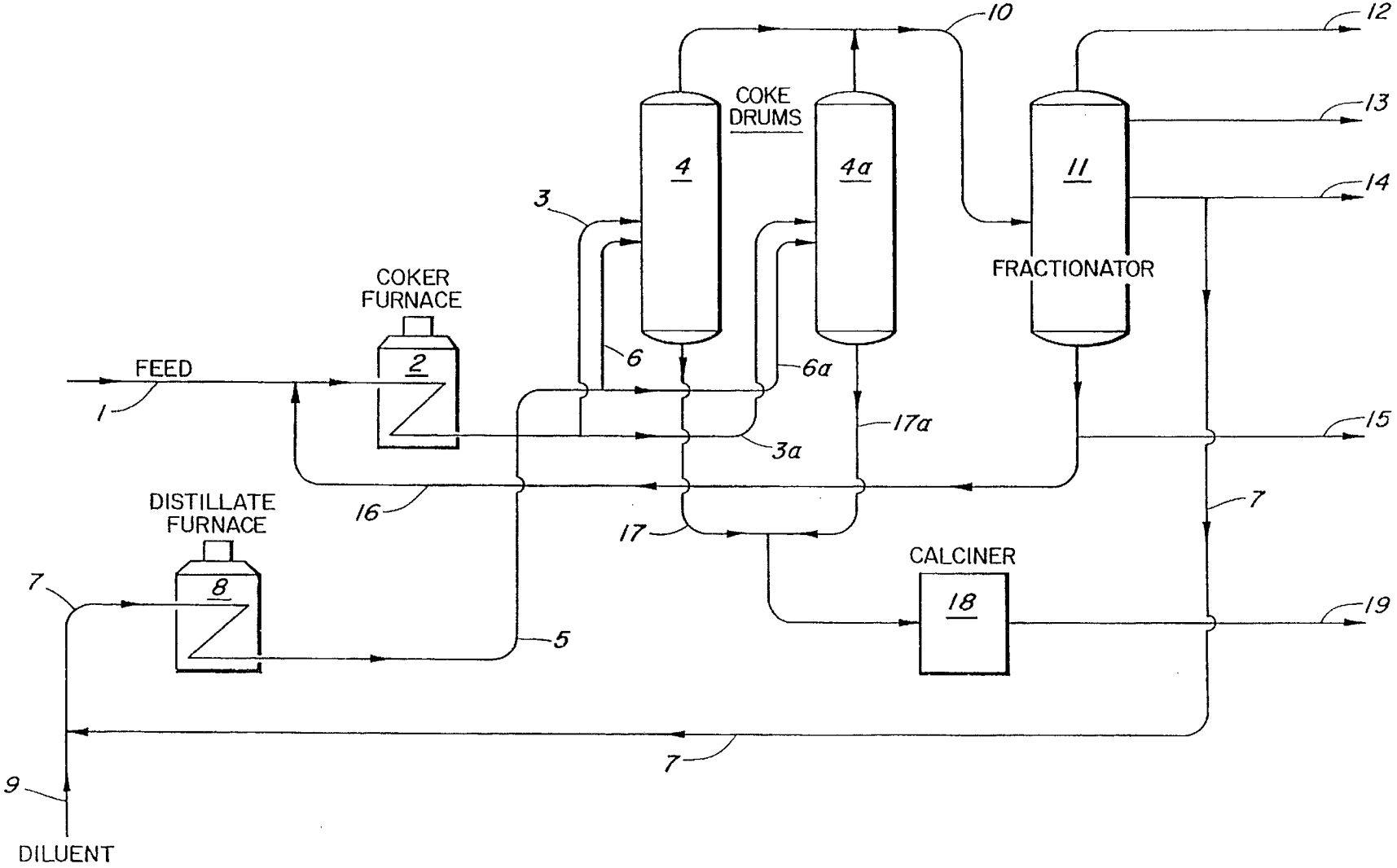
12
13
14
15
19
7
11
FRACTIONATOR
10
CALCINER
18
17a
4a
6a
3a
COKE DRUMS
4
6
17
7
3
5
COKER FURNACE
2
16
DISTILLATE FURNACE
8
FEED
1
7
9
DILUENT

METHOD FOR INCREASING YIELD OF LIQUID PRODUCTS IN A DELAYED COKING PROCESS

FIELD OF THE INVENTION

This invention relates to delayed coking, and more particularly to a method of increasing the yield of liquid products and a decrease in coke yield in a delayed coking operation based on feedstock to the coker.

THE PRIOR ART

Delayed coking has been practiced for many years. The process broadly involves thermal decomposition of heavy liquid hydrocarbons to produce gas, liquid streams of various boiling ranges, and coke.

Coking of resids from heavy, sour (high sulfur) crude oils is carried out primarily as a means of disposing of low value resids by converting part of the resids to more valuable liquid and gas products. The resulting coke is generally treated as a low value by-product, but which coke has utility as a fuel (fuel grade), crudes for alumina manufacture (regular grade) or anodes for steel production (premium grade).

The use of heavy crude oils having high metals and sulfur content is increasing in many refineries, and delayed coking operations are of increasing importance to refiners. The increasing need to minimize air pollution is a further incentive for treating resids in a delayed coker, as the coker produces gas and liquids having sulfur in a form that can be relatively easily removed in existing refinery units.

In the basic delayed coking process as currently commercially practiced, liquid feedstock is introduced to a fractionator. The fractionator bottoms, including recycle material, are heated to coking temperature in a coker furnace to provide hot coker feed. The hot feed then goes to a coke drum maintained at coking conditions of temperature and pressure where the liquid feed soaks in its contained heat to form coke and volatile components. The volatile components are recovered and returned to the fractionator, where such components are recovered as liquid products. When the coke drum is full of solid coke, the feed is switched to another drum, and the full drum is cooled and emptied by conventional methods.

Various modifications have been made in the basic delayed coking process. For example, U.S. Pat. No. 4,455,219, Janssen et al, discloses a delayed coking process in which a diluent hydrocarbon having a boiling range lower than the boiling range of heavy recycle is substituted for a part of the heavy recycle that is normally combined with the fresh coker feed. This procedure results in an improved coking process in which increased liquid products are obtained with a corresponding reduction in coke yield.

U.S. Pat. No. 4,518,487, Graf et al, provides a further modification in the delayed coking process by replacing all of the heavy recycle with a lower boiling range diluent hydrocarbon fraction. Here again an improved delayed coking process results, with increased liquid products and reduced coke yield.

Still another modification is disclosed in U.S. Pat. No. 4,661,241 which in one aspect describes a single pass delayed coking process in which the feedstock employed in the process contains neither heavy recycle nor lower boiling range diluent. This patent does disclose, however, that a diluent material may be added to the effluent from the coker furnace or introduced to the coke drum.

In the basic delayed coking process, and in the various modifications, disclosed in U.S. Pat. Nos. 4,455,219; 4,518,487; and 4,661,241 an important factor in determining the amount and kinds of liquid products and the amount of coke formed is the temperature of the coking reactions which take place in the liquid material in the coke drum. Generally, the higher the coking temperature the greater is the yield of liquid products from the coking process. An increase in liquid yield is accompanied by a reduction in coke yield, which is preferable since coke is the least valuable material produced in the delayed coking of heavy resids. In the prior art methods, heating the feedstock to higher temperature promotes coking in the furnace tubes, causing shutdown and delays for cleaning the furnace. Thus, in the prior art, practitioners of delayed coking attempted to maintain the temperature of the coker feedstock leaving the coker furnace as high as possible, without exceeding the temperature level at which coking would occur in the furnace tubes. Such premature coking quickly plugs the tubes requiring shutdown of the furnace until the coke can be removed. Thus, while higher temperature delayed coking may be desirable, the coking operation has been limited by the temperature to which the coker feedstock can be heated prior to its introduction to the coke drum.

SUMMARY OF THE INVENTION

According to the process of this invention, supplemental heat input to the coke drum in a delayed coking process is obtained by introducing to the coke drum a heated hydrocarbon non-coking diluent having a heat content sufficient to increase the temperature of the liquid in the coke drum as indicated by coke drum vapor pressure at the top of the coke drum. The hydrocarbon non-coking diluent may be introduced directly to the coke drum or it may be combined with coker furnace effluent prior to the coke drum, or both. Heating is carried out separately from the coker feedstock furnace in order to reach the elevated temperature necessary to increase the overall coke drum temperature.

In addition to increasing coke yields for typical coker feeds, the present invention also allows the processing of coke feeds difficult and unsatisfactory for coking operations because of excessive coking in the feedstock furnace. Examples of such previously difficult feeds which coke at low temperatures are paraffinic resids, heavy vacuum resids, deasphalted pitch, visbreaker bottoms and hydrocracker bottoms. Practice of the present invention allows operation of the delayed coker feedstock furnace at sufficiently low temperatures to minimize coke formation in the furnace tubes to increase furnace run lengths, while allowing the coke drum to be operated at higher than normal temperatures in order to maximize more valuable liquid yields and decrease less valuable coke yields.

BRIEF DESCRIPTION OF THE DRAWING

The drawing is a schematic flow diagram of a coking unit which illustrates the invention.

DETAILED DESCRIPTION OF THE INVENTION

Referring now to the Figure, feedstock is introduced into the coking process via line 1. The feedstock, which may be a topped crude, vacuum resid, deasphalted pitch, visbreaker bottoms, FCC slurry oils and the like, is heated in furnace 2 to temperatures normally in the range of about 850° F. to about 1100° F. and preferably between about 900° F. to about 975° F. A furnace that heats the vacuum resid rapidly to such temperatures is normally used. The vacuum resid, which exits the furnace at substantially the previously indicated temperatures, is introduced through line 3 into the bottom of coke drum 4. The coke drum is maintained at a pressure of between about 10 and about 200 psig and operates at a temperature in the range of about 800° F. to about 1000° F., more usually between about 820° F. and about 950° F. Inside the drum the heavy hydrocarbons in the feedstock thermally crack to form cracked vapors and coke.

The coking and cracking reactions in the coke drum take place in a pool or body of liquid vacuum resid or other coking hydrocarbons. To increase the temperature of this liquid and thereby reduce the yield of coke and increase the yield of other products, a diluent non-coking hydrocarbon stream of sufficiently high temperature to raise the overall coke drum contents temperature above that achieved by the coking feedstock furnace is introduced to coke drum 4. This non-coking hydrocarbon diluent having elevated temperature may be combined with furnace effluent feedstock thru lines 5 and 3 (not shown) or may be introduced directly to the coke drum via lines 5 and 6 as illustrated.

The diluent non-coking hydrocarbon used to increase the temperature of the coke drum liquid may be an individual hydrocarbon or hydrocarbons or even a virgin untreated hydrocarbon having requisite characteristics, but usually is a hydrocarbon fraction obtained as a product or by-product in a petroleum refining process. Typical fractions used as non-coking diluents are petroleum distillates such as light or medium boiling range gas oils or fractions boiling in the range of diesel fuels. The term "non-coking diluent" means the diluent generally exits the coke drum overhead, although as those skilled in the coking art appreciate, some minor portion of these diluents may form coke. The boiling range of the diluent employed is at least in part lower than the boiling range of the normal heavy recycle which is used in the conventional delayed coking process. This heavy recycle is made up primarily of material boiling above about 750° F. and in most cases above about 850° F. Typically the non-coking diluent which is used in the process has a boiling range of between about 335° F. and about 850° F., more usually from about 450° F. to about 750° F. and preferably from about 510° F. to about 650° F. The amount of non-coking diluent used will depend on the temperature of the distillate and the increase in coking temperature desired. Usually the diluent will be introduced in an amount between about 0.01 to about 1.00 barrels per barrel of coking feed to the coke drum and more usually between about 0.10 and about 0.20 barrels of non-coking hydrocarbon diluent per barrel of coking feed, to produce an overall coke drum temperature increase of 1° F. to 50° F. and preferably 5° F. to 15° F. as measured by the coke drum vapor temperature at the top of the coke drum.

The non-coking hydrocarbon diluent may conveniently be obtained from a non-coking hydrocarbon diluent from the coking process, e.g. light gas oil from the coking fractionator. If the delayed coker is one of many units in a conventional petroleum refinery, a non-coking hydrocarbon diluent material from one or more of the other units may be used.

In order to effect the purpose of the invention, the heat content of the non-coking hydrocarbon diluent entering the coke drum must be sufficient to increase the temperature of the hydrocarbon and coke in the coke drum. Because of its boiling range, non-coking hydrocarbon diluent obtained from a refining unit does not contain sufficient heat for direct employment in the coking process. The heat content of such non-coking hydrocarbon diluent is increased to the desired level, either by heat exchange or more usually by heating in a furnace. Ordinarily the furnace employed will be a pipestill of the same type used for heating the coker feedstock, although choice of such furnace is a matter of mere convenience. The heat content of the heated non-coking hydrocarbon diluent usually a diluent, will be reflected by its temperature, which may be as high as several hundred degrees above the liquid temperature in the coke drum. Usually, but not critically, the non-coking hydrocarbon diluent will be introduced to the coking process at a temperature between about 10° F. and about 200° F. above the coke drum liquid temperature, and in sufficient quantity to raise the overall coke drum temperature at least 1° F., and preferably 5° F. to 10° F. as measured by vapor temperature at the top of the coke drum. The quantity used depends on the temperature of the diluent as it enters the coke drum, and the coke drum temperature increase desired.

Referring again to the drawing, cracked vapors are continuously removed overhead from coke drum 4 through line 10. Coke accumulates in the drum until it reaches a predetermined level at which time the feed to the drum is shut off and switched to a second coke drum **4*a* wherein the same operation is carried out. This switching permits drum 4** to be taken out of service, opened and the accumulated coke removed therefrom using conventional techniques. The coking cycle may require between about 10 and about 60 hours but more usually is completed in about 16 to about 48 hours.

The vapors that are taken overhead from the coke drums are carried by line 10 to a fractionator 11. As shown in the drawing, the vapors will typically be fractionated into a $C_1$–$C_3$ product stream 12, a gasoline product stream 13, a light gas oil product stream 14 and a coker heavy gas oil taken from the fractionator via line 15.

A portion of the coker heavy gas oil from the fractionator can be recycled at a desired ratio to the coker furnace through line 16. Any excess net bottoms may be subjected to conventional residual refining techniques as desired.

Green coke is removed from coke drums 4 and **4*a* through outlets 17 and 17*a*, respectively, and introduced to calciner 18 where it is subjected to elevated temperatures to remove volatile materials and to increase the carbon to hydrogen ratio of the coke. Calcination may be carried out at temperatures in the range of between about 2000° F. and about 3000° F. and preferably between about 2400° F. and about 2600° F. The coke is maintained under calcining conditions for between about one half hour and about ten hours and preferably between about one and about three hours. The calcining temperature and the time of calcining will vary depending on the density of the coke desired. Calcined premium coke which is suitable for the manufacture of large graphite electrodes is withdrawn from the calciner through outlet 15**.

The non-coking diluent material, which is heated in order to raise the coke drum temperature, may conveniently be obtained from the coker fractionator. For example, the light gas oil leaving the fractionator through line 14 may be used for this purpose. With such election, this material in the amount desired is passed via line 7 to distillate furnace 8 where it is heated to a temperature sufficient to increase the heat content of the non-coking diluent, for example, 900° F. The heated non-coking diluent is then introduced to the coker thru line 5 as previously described in an amount sufficient to effect the desired increase in the temperature of the liquid in coke drum 4. Alternatively, non-coking diluent may be obtained from other sources such as refinery units and introduced to the coker via line 9. Diluent from such other sources may constitute a part or all of the non-coking diluent used in the process as is convenient and economical.

While the invention has been described in detail in its application to a conventional delayed coking process in which heavy gas oil is recycled to the coker feedstock furnace, the process of the invention also finds application in other delayed coking processes. For example, it may be utilized to provide still further reduction in coke manufacture in the process described in U.S. Pat. No. 2,455,218 in which diluent is substituted for a part of the heavy recycle; in the process of U.S. Pat. No. 2,518,487 wherein all of the heavy recycle is displaced with distillate and in the single pass process of U.S. Pat. No. 4,661,241 where no recycle is employed. The invention finds particular application in the processes of U.S. Pat. Nos. 2,455,218 and 2,518,487.

The following example illustrates the results obtained in carrying out the invention. The example is provided to illustrate the present invention and is not intended to limit the invention.

EXAMPLE

The reduced coke yield provided by the process of the invention is demonstrated in the following simulated example derived from a highly developed coker design program. In this example, three runs were simulated using identical feedstocks. In the first run, or base case, conventional heavy distillate recycle (5 parts for each 100 parts fresh feed) was used for part of the recycle and the remainder of the recycle (10 parts for each 100 parts fresh feed) was a non-coking hydrocarbon diluent material having a boiling range of 335° F. to 650° F.

In the second run the 10 parts of non-coking hydrocarbon diluent was excluded from the recycle, was heated separately and was combined with heated feedstock containing 5 parts heavy distillate recycle leaving the coker feedstock furnace.

The third run was the same as the first run except that an additional amount of non-coking hydrocarbon diluent (10 parts for each 100 parts fresh feed) was heated separately and then combined with heated feedstock containing 5 parts heavy distillate recycle and 5 parts diluent recycle leaving the coker feedstock furnace.

In each of the runs, a feedstock having an API gravity of 3.2, a Conradson carbon content of 23 percent by weight, a characterization factor "K" of 11.31 and a sulfur content of 3.05 percent by weight was coked at a pressure of 25.0 psig and the temperature shown in the following table.

In Run No. 2, the non-coking hydrocarbon diluent was heated to 930° F. before being combined with the heated feedstock plus heavy distillate recycle. In Run No. 3, the separate non-coking hydrocarbon diluent stream was heated to 950° F.

The product distribution from the three runs is shown in the following table.

| Component | Run No. 1 Distillate Recycle Base Case Top Temperature of Coke Drum - 825° F. | Run No. 2 Distillate (930° F.) Heated Separately Top Temperature of Coke Drum - 835° F. | Run No. 3 Additional Distillate (950° F.) Heated Separately Top Temperature of Coke Drum - 835° F. |
|---|---|---|---|
| | Weight Percent | | |
| $H_2S$ | 0.88 | 0.88 | 0.88 |
| $H_2$ | 0.09 | 0.09 | 0.09 |

-continued

| Component | Run No. 1 Distillate Recycle Base Case Top Temperature of Coke Drum - 825° F. | Run No. 2 Distillate (930° F.) Heated Separately Top Temperature of Coke Drum - 835° F. | Run No. 3 Additional Distillate (950° F.) Heated Separately Top Temperature of Coke Drum - 835° F. |
|---|---|---|---|
| | Weight Percent | | |
| $C_1$ | 3.71 | 3.68 | 3.68 |
| $C_2$ | 1.57 | 1.62 | 1.79 |
| $C_3$ | 1.89 | 1.95 | 2.14 |
| $C_4$ | 2.03 | 2.11 | 2.32 |
| $C_5$-335° F. | 13.29 | 13.42 | 13.76 |
| 335–510° F. | 10.60 | 10.53 | 10.09 |
| 510–650° F. | 7.54 | 7.48 | 6.55 |
| 650° F.+ | 24.82 | 25.26 | 26.28 |
| Coke | 33.58 | 32.96 | 32.41 |

The foregoing example indicates that about a 1.84 percent reduction in coke yield (32.96 percent versus 33.58 percent) results when non-coking hydrocarbon diluent is removed from the recycle to the coker, heated separately to a higher temperature and introduced to the coking drum to increase the vapor temperature in the coke drum. A greater reduction in coke yield (3.48 percent) results when an additional amount of non-coking hydrocarbon diluent is heated separately to increase the temperature at the top of the coke drum.

Similar reductions in coke yield can be obtained with different operating conditions and utilizing other feedstocks. The process of the invention provides flexibility in operation to meet market conditions which may dictate variable product distribution and a minimum amount of coke production.

While certain embodiments and details have been shown for the purpose of illustrating this invention, it will be apparent to those skilled in this art that various changes and modifications may be made herein without departing from the spirit or the scope of the invention.

I claim:

1. In a delayed coking process in which a liquid coking feedstock is heated to an elevated temperature and is charged to a coking drum under delayed coking conditions wherein such liquid feedstock soaks in its contained heat which is sufficient to convert the feedstock to cracked vapors, which cracked vapors upon cooling are condensed to liquid products, and coke, the improvement which comprises introducing to the coking drum a non-coking hydrocarbon diluent heated separately from the coker feedstock and which has a heat content which is sufficient to increase the temperature level of the liquid feedstock in the coking drum, whereby liquid products from the coking process are increased and coke product is decreased.

2. A process as described in claim 1 wherein the temperature increase in the coke drum contents is at least 1° F.

3. A process as described in claim 2 wherein the temperature increase is at least 10° F.

4. The process of claim 3 in which one of the liquid products from the coking process is a heavy gas oil which may be recycled at least in part to the coking process.

5. The process of claim 4 in which the coking feedstock is combined with a non-coking hydrocarbon diluent which is a non-coking hydrocarbon diluent having a boiling range which at least in part is less than the boiling range of the heavy gas oil.

6. The process of claim 5 in which the non-coking hydrocarbon diluent at least in part is one of the liquid products from the coking drum.

7. The process of claim 5 in which heavy gas oil is recycled to the coking process to form at least a part of the heated non-coking diluent.

8. The process of claim 5 in which heavy gas oil and non-coking hydrocarbon diluent are recycled at least in part as heated non-coking hydrocarbon diluent to the coking process.

9. The process of claim 5 in which no recycle is used in the coking process and all heated non-coking hydrocarbon diluent is obtained outside of the coking process.

10. In a delayed coking process in which a heavy liquid hydrocarbon oil is heated to between about 825° F. and about 1100° F. and introduced to a coking drum wherein such liquid feedstock soaks in its contained heat at a temperature between about 800° F. and about 1000° F. and a pressure between about 10 psig and about 200 psig to convert the feedstock to vapors, which upon cooling are condensed substantially to liquid products, and coke, and wherein one of the liquid products is a heavy gas oil, at least a portion of which is recycled to the process, the improvement which comprises introducing to the coking drum a non-coking hydrocarbon diluent which has been heated separately from the coker feedstock to provide a heat content which is sufficient to increase the temperature of the liquid feedstock in the coking drum at least 1° F. whereby liquid products from the coking process are increased and coke product is decreased.

11. The process of claim 10 in which the non-coking hydrocarbon diluent is at least in part obtained from one of the liquid products from the coking process.

12. The process of claim 11 in which the non-coking hydrocarbon diluent is heated to a temperature between about 10 ° F. and about 300° F. above the temperature of the liquid in the coke drum.

13. The process of claim 12 in which the non-coking hydrocarbon diluent has a boiling range which at least in part is less than the boiling range of the heavy gas oil.

14. The process of claim 13 in which the boiling range of the non-coking hydrocarbon diluent is between about 335° F. and about 850° F.

* * * * *